US008628075B2

(12) United States Patent
De La Hamayde

(10) Patent No.: US 8,628,075 B2
(45) Date of Patent: Jan. 14, 2014

(54) FEED MECHANISM FOR LAMINATING MACHINE

(75) Inventor: Sebastien De La Hamayde, Leicester (GB)

(73) Assignee: Vivid Laminating Technogies Limited, Coalville (GB)

( * ) Notice: Subject to any disclaimer, the term of this patent is extended or adjusted under 35 U.S.C. 154(b) by 0 days.

(21) Appl. No.: 13/576,255

(22) PCT Filed: Feb. 4, 2011

(86) PCT No.: PCT/GB2011/000147

§ 371 (c)(1),
(2), (4) Date: Jul. 31, 2012

(87) PCT Pub. No.: WO2011/095778

PCT Pub. Date: Aug. 11, 2011

(65) Prior Publication Data

US 2012/0292847 A1 Nov. 22, 2012

(30) Foreign Application Priority Data

Feb. 4, 2010 (GB) ..... 1001814.1

(51) Int. Cl.
*B65H 3/12* (2006.01)
*B65H 5/24* (2006.01)

(52) U.S. Cl.
CPC ..... *B65H 5/24* (2013.01)
USPC ..... 271/94; 271/90; 271/101; 271/30.1

(58) Field of Classification Search
USPC ..... 271/90, 94, 97, 98, 101, 105, 30.1, 31
See application file for complete search history.

(56) References Cited

U.S. PATENT DOCUMENTS

| | | | | |
|---|---|---|---|---|
| 5,511,773 | A * | 4/1996 | Burger | 271/148 |
| 5,645,274 | A * | 7/1997 | Ubayashi et al. | 271/94 |
| 6,123,329 | A * | 9/2000 | Sato et al. | 271/9.01 |
| 6,283,469 | B1 * | 9/2001 | Weber | 271/148 |
| 6,629,693 | B2 * | 10/2003 | Siow et al. | 271/171 |
| 7,722,029 | B2 * | 5/2010 | Gruntjes et al. | 271/97 |
| 8,408,533 | B2 * | 4/2013 | Fuda | 271/96 |
| 8,480,073 | B1 * | 7/2013 | Ishikawa et al. | 271/18.2 |
| 2008/0088078 | A1 * | 4/2008 | Kushida | 271/90 |
| 2009/0166950 | A1 * | 7/2009 | Sciurba et al. | 271/9.03 |
| 2009/0243196 | A1 * | 10/2009 | Kawamoto | 271/147 |
| 2011/0187044 | A1 * | 8/2011 | Utagawa et al. | 271/98 |

OTHER PUBLICATIONS

International Search Report for PCT/GB11/000147, May 20, 2011.

* cited by examiner

*Primary Examiner* — Kaitlin Joerger
(74) *Attorney, Agent, or Firm* — Clifford Kraft

(57) ABSTRACT

Means (17, 22, 23, 24, 25) is provided for intermittently lifting a stack (13) of paper so that the topmost sheet is captured by the suction of a traction device (15) and carried forward by the endless belt of the latter to the input end (21) of a laminating machine. Before the trailing end of the captured sheet has left the traction device (15) the lifting means again lifts the stack (13) so that the next sheet is captured in an overlapping relation to the first.

12 Claims, 6 Drawing Sheets

FEED MECHANISM FOR LAMINATING MACHINE

This invention relates to a feed mechanism for a laminating machine and more specifically to a mechanism for feeding individual sheets to be laminated from a stack in succession to a laminating machine of the kind which draws from a roll a continuous film of laminating material and lays it on the sheets as they travel in an overlapping relation through heated rollers to effect the lamination. The sheets are "oversize" to allow for the overlap and the overlapping areas are subsequently trimmed off. For example to create A3 posters sheets of SRA3 are fed to the laminating machine and after laminating are trimmed to A3 size.

Heavy duty feed mechanisms are available for laminating on an industrial scale but these are costly and cumbersome. A principal object of the present invention is to provide a more simple and economical feed mechanism.

In accordance with the present invention there is provided a feed mechanism for supplying similar sheets to be laminated from a stack thereof in succession but in an overlapping relationship to a laminating machine, the feed mechanism comprising a table for supporting a stack of individual sheets to be laminated, all of the same dimensions and an endless-belt traction device equipped with suction above the table, characterised by the provision of height-adjustment means for maintaining the traction device at a predetermined spacing above the stack as the stack diminishes and means for elevating the stack from the table to bring the topmost sheet to be captured and displaced by the traction device, the elevating means being actuated to lift the stack before the trailing end of a sheet being moved by the traction device has left the same so that the sheets are fed to the laminating machine in an overlapping relation.

Said means for maintaining the traction device at a predetermined spacing above the stack may include a sensor which controls the height-adjustment means to maintain a constant distance between itself and the topmost sheet of the stack. The height-adjustment means may be adapted to raise the table as the stack diminishes. It may comprise a lazy tongs which supports the table. Alternatively the height-adjustment means may be adapted to lower the traction device as the stack diminishes.

Means is preferably provided for timing a reciprocating movement of the elevating means in accordance with the length of the stack and the speed at which the laminating machine is operating to achieve the desired overlap. The elevating means may be a cam rotatably mounted beneath the top of the table and means is preferably provided for rotating the cam initially in an anti-clockwise direction to lift a leading portion of a first sheet toward the traction device and thereafter intermittently rotating the cam in a clockwise direction to lift a subsequent sheet into contact with a trailing portion of the sheet being moved by the traction device.

Alternatively the elevating means may comprise a plunger reciprocable between a position below and a position above the top surface of the table. Preferably the elevating means comprises two plungers reciprocable between positions below and above the top surface of the table, a first plunger being nearer to the leading edge of the stack than the other, the first plunger being actuated to lift the stack to bring a topmost sheet of the stack to be captured and displaced by the traction device and the other plunger being thereafter actuated to bring subsequent sheets into contact with the traction device in an overlapping relationship with preceding sheets.

The elevating means may comprise one or more blowers which direct jets of air to the stack to separate upper sheets of the stack, the blower operating intermittently to achieve a desired overlap of sheets displaced by the traction device.

Preferred embodiments of the invention will now be described by way of non-limitative example with reference to the accompanying schematic drawings, in which.

All four embodiments of the invention illustrated have features in common which have been given the same reference numerals.

Figure 1:
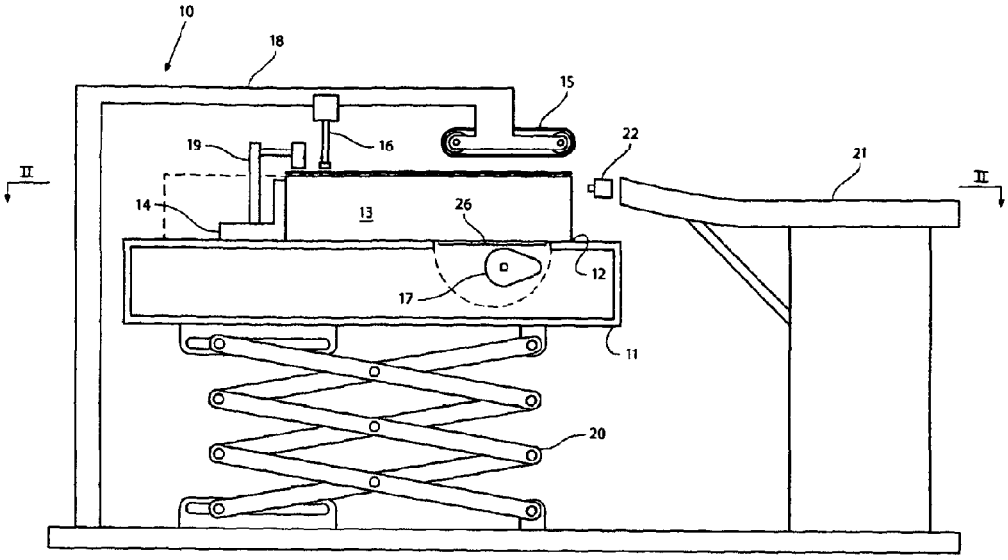
FIG. 1 is a sectional elevation illustrating a feed mechanism in accordance with a first embodiment of the invention at the commencement of a feeding operation.
Figure 2:
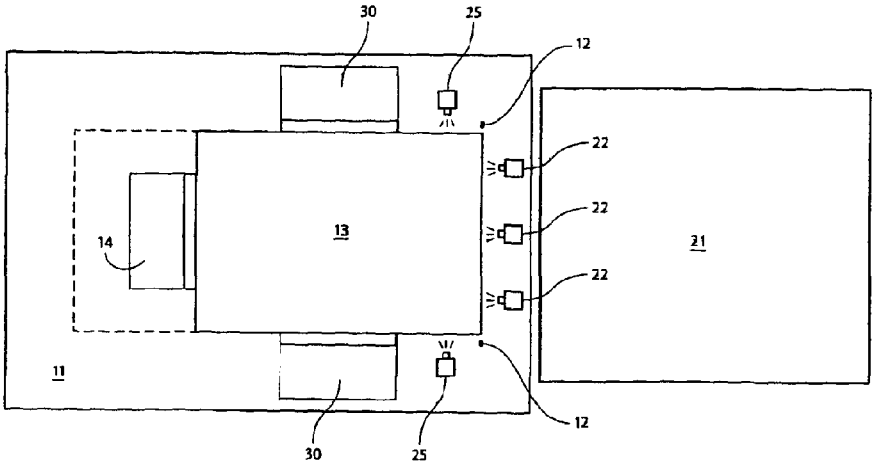
FIG. 2 is a sectional plan view taken on the line II-II of FIG. 1.

The feed mechanism 10 illustrated in FIGS. 1-5 is positioned suitably close to a conveyor 21 at the input end of a laminating machine. The latter is not illustrated but is of the well-known kind which conveys sheets to be laminated in an overlapping relation between heated rollers, having first laid onto the sheets a continuous film of laminating material drawn from a roll.

The mechanism 10 is designed to lift sheets of paper from a stack 13 thereof and pass them in succession but in an overlapping relation to the conveyor 21. The mechanism comprises a table 11 on which a stack 13 of paper has been loaded. There is a mark 12 on the top of the table against which the operator positions the leading edge of the stack 13. A slide 14 is brought into abutment with the trailing end of the stack and side plates 30 (FIG. 2) are brought in against the sides of the stack. The final position of the slide 14 could be used to detect the length of the stack, or the size of paper could simply be programmed into the machine by the operator. By way of example the stack 13 is of SRA3 paper. If it were of SRA2 paper the slide 14 would move back to behind a stack extended by the dotted lines.

Suspended above the table 11 is a traction device 15. This is of a known kind and will not be described in detail, but it comprises a perforated endless belt extending horizontally and provided internally with the inlet of a suction device, so that paper lifted toward the underside of the belt will be captured by the belt and move with it. The device 15 is carried by a structure 18 from which there also depends a sensor 16. A pressure element 19 exerts to a gentle pressure on a rear region of the stack.

The table 11 is supported by lazy tongs 20. A screw device (not shown) extends or retracts the lazy tongs 20 to raise or lower the table 11. The screw device is controlled by the sensor 16 in such a way as to maintain a constant spacing of the traction device 15 above the is stack 13 as the latter diminishes. This spacing say approximately 3 cm—is just sufficient to prevent the suction of the traction device 15 lifting paper from the stack 13 until a topmost sheet of the stack has been lifted toward the traction device 15 as will now be described.

Beneath the top of the table 11 and operating through a slot therein is a cam 17 angularly moveable about a horizontal axis. The slot is covered by a plate 26 which can be displaced by the cam 17. FIG. 1 illustrates the start position in which the cam 17 does not extend through its slot above the top of the table 11.

Figure 3:
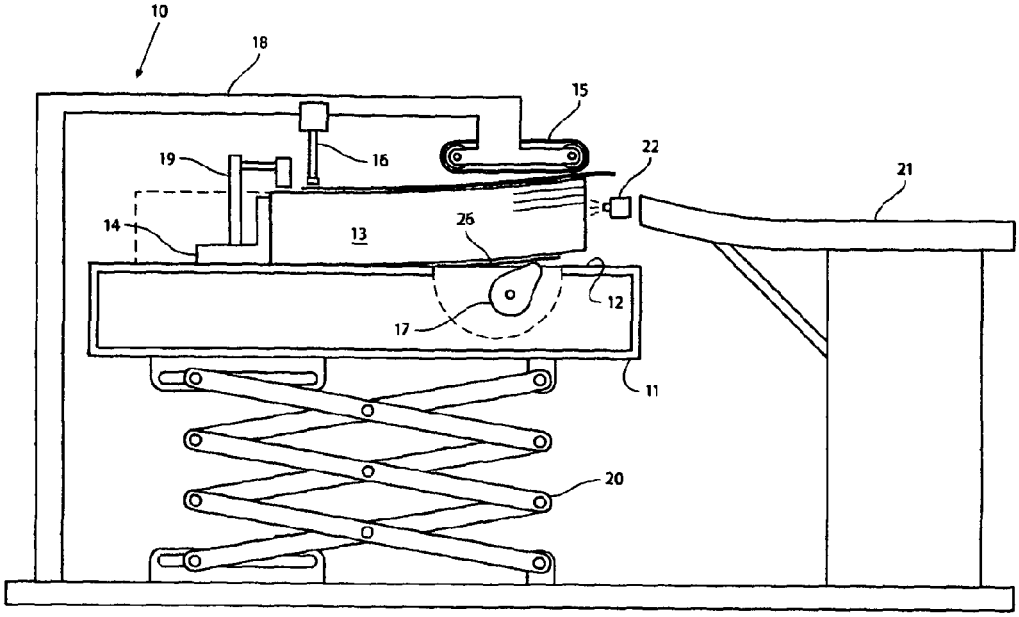
FIG. 3 shows the mechanism of FIGS. 1 and 3 lifting a first sheet from a stack.

To enable the traction device 15 to draw the topmost sheet from the stack 13 the cam 17 is rotated counter-clockwise to the 1 o'clock position shown in FIG. 3. A leading edge of the topmost sheet is thus lifted toward the belt of the traction device 15, which commences to move the first sheet onto the conveyor 21 of the laminating machine.

It will be apparent from the drawings that in all embodiments of the invention the means, such as the cam 17, for elevating the stack does not press the stack against the underside of the traction device. Instead it raises the stack just sufficiently for its topmost sheet to be sucked up to the traction device, which then transports it to the conveyor 21. A sheet of paper lifted to within, say 1 cm, of the underside of the belt of the traction device 15 will then travel with the belt.

To assist the separation of the sheets of the stack an array of three blowers 22 blow jets of air at the leading end of the stack 13 and blowers 25 blow air at its sides. To prevent the blowers 22 from blowing sheets from the stack backwards away from the conveyor 21 a pressure element 19 exerts pressure on the rear end of the stack 13. This pressure is gentle enough to be overcome by the traction device 15 when it is pulling a sheet from the top of the stack. The pressure element 19 may have a spring-loaded plunger (not shown) or it may simply be a weight.

Figure 4:
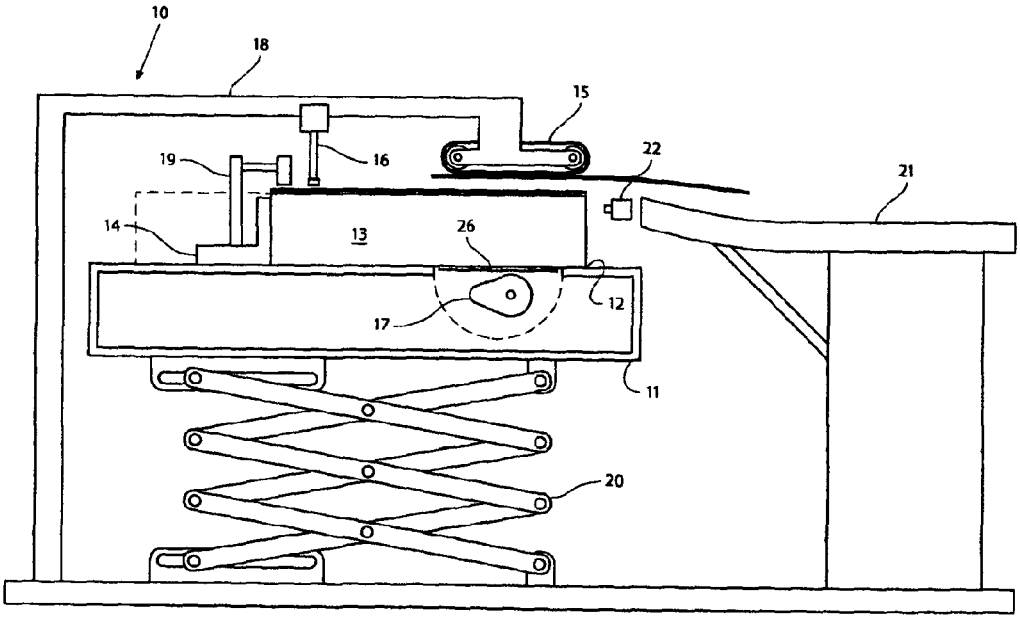
FIG. 4 shows an intermediate stage in which the stack is not lifted.

FIG. 4 illustrates an intermediate operation in which the stack 13 is not lifted by the cam 17 and the air jets 22 and 25 are switched off. In this situation the underside of the belt of the traction device 15 is wholly obscured by the sheet it is carrying and there is no tendency for a subsequent sheet to rise into contact with the first sheet.

Figure 5:
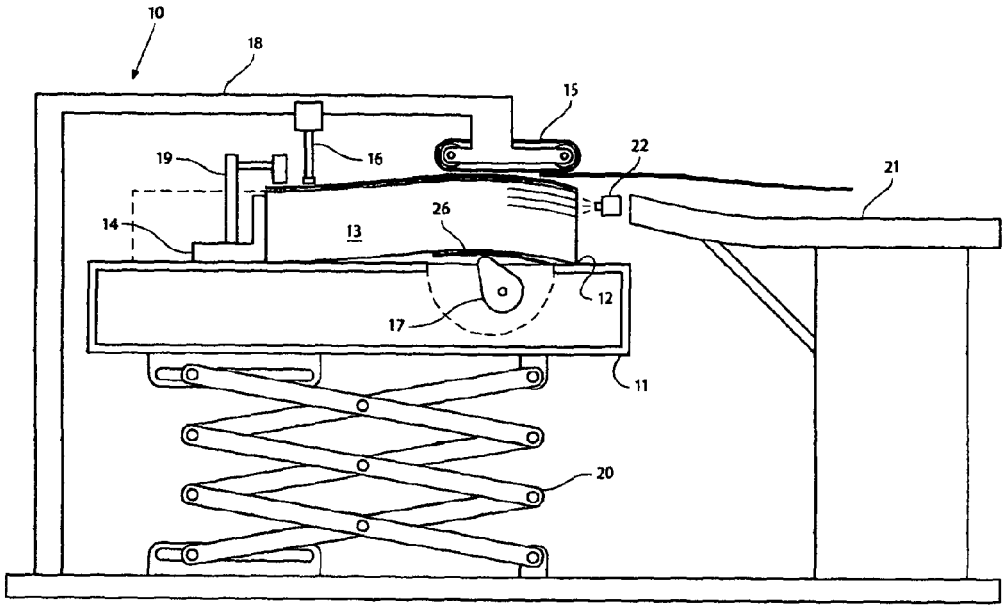
FIG. 5 shows the mechanism of FIGS. 1-4 lifting a subsequent sheet into overlapping relation with the first sheet.

As the trailing edge of the topmost sheet is about to leave the traction device 15 the cam 17 is rotated clockwise to the 11 o'clock position of FIG. 5. It thus lifts the stack 13 so that a subsequent sheet, now the topmost sheet of the stack 13, is brought towards the belt of the traction device behind the trailing edge of the sheet now on the conveyor 21. The two sheets are thus passed to the conveyor 21 in an overlapping relation.

To bring each subsequent sheet to be moved by the traction device 15 the cam 17 is rotated to and from the position of FIG. 5. The frequency of this displacement of the cam 17 is determined by the length of the paper of the stack 13 and the speed at which the conveyor 21 is operating. Meanwhile the sensor 16 controls the lazy tongs 20 so that there is a constant spacing between the top of the stack 13 and the traction device 15 as the stack 13 diminishes.

Figure 6:
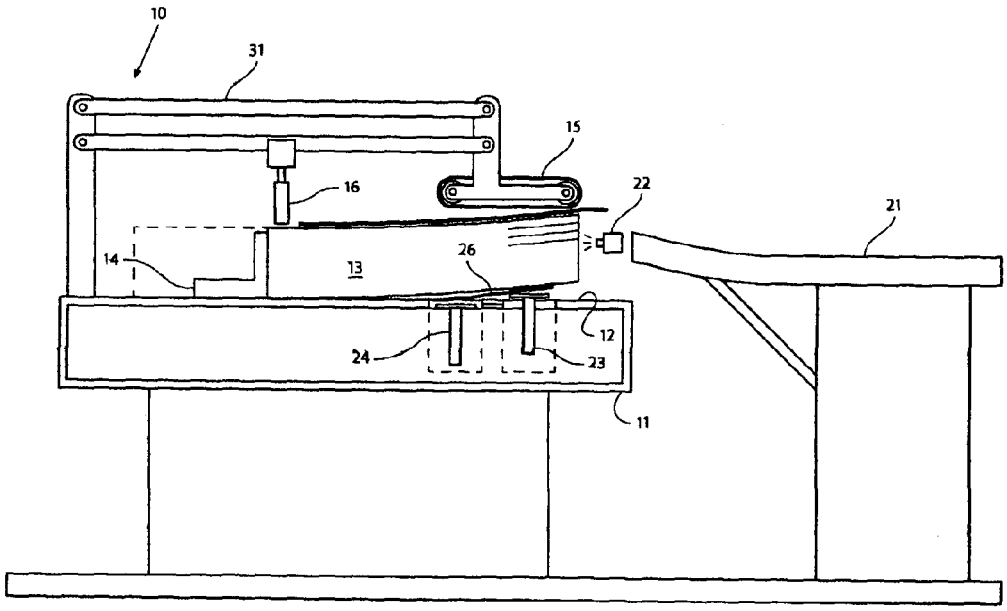
FIG. 6 is a view similar to FIG. 1 of a second embodiment of the invention as shown lifting a first sheet from a stack.
Figure 7:
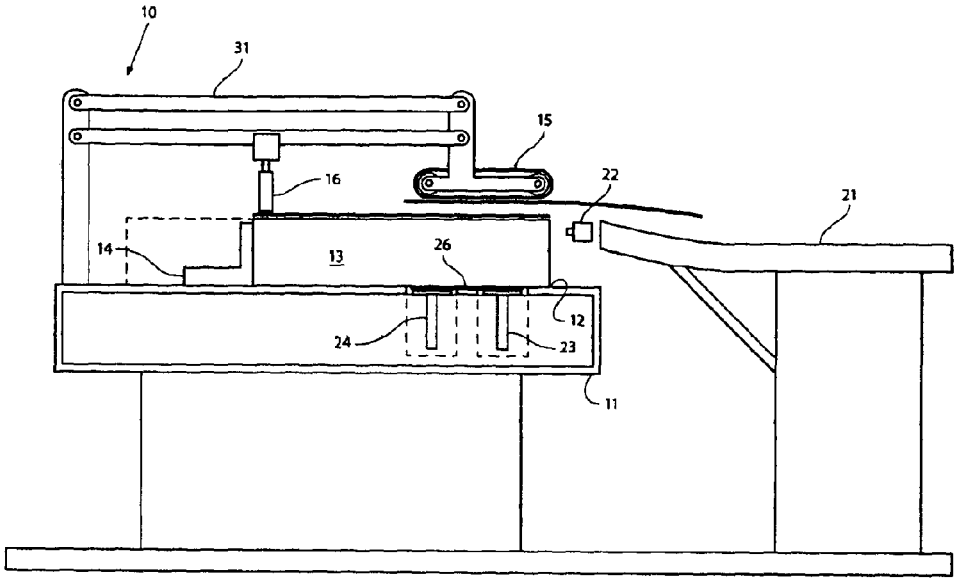
FIG. 7 illustrates an intermediate stage using the mechanism of FIG. 6 in which the stack is not lifted.
Figure 8:
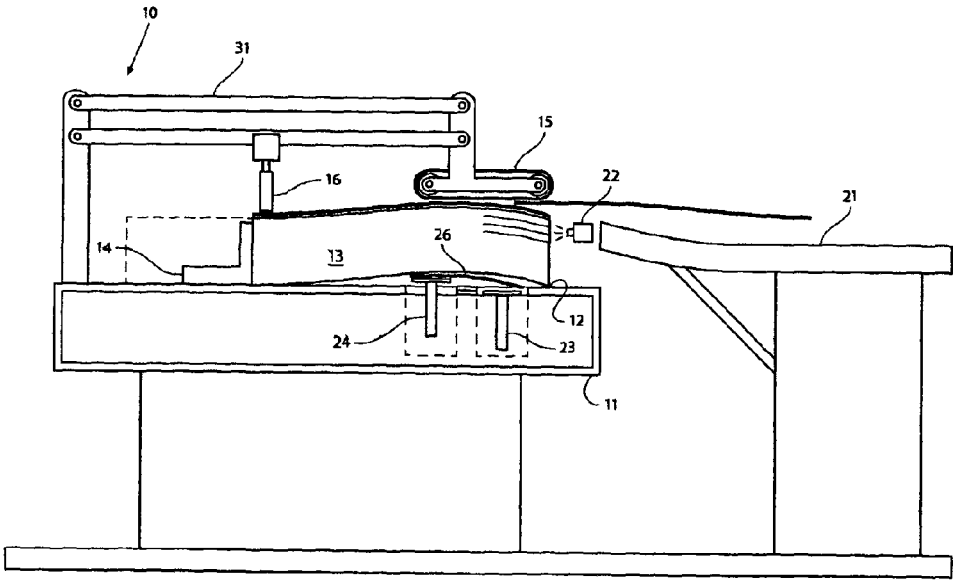
FIG. 8 illustrates the mechanism of FIGS. 6 and 7 lifting a subsequent sheet into overlapping relation with the first sheet.

The feed mechanism of FIGS. 6 to 8 functions in a manner similar to that of FIGS. 1 to 5. It lifts a stack 13 of paper so that the topmost sheet of the stack becomes influenced by the belt of a traction device 15 which passes the sheets in succession but in an overlapping relation to the conveyor 21. In this embodiment, however, the constant spacing of the traction device 15 above the top of the stack 13 is maintained not by lifting the table 11 but by lowering the traction device 15. To this end the traction device 15 is supported not by a fixed structure but by a pivotable linkage arrangement 31 under the control of the sensor 16.

Also in this embodiment the cam 17 is replaced by a pair of solenoid-actuated plungers 23 and 24 which move through respective openings in the top of the table 11 from positions within the table to positions above it, thus displacing a plate 24 covering the openings. To bring a first sheet from the top of the stack 13 toward the belt of the traction device 15 the plunger 23 is extended as shown in FIG. 6 while air is played on the forefront of the stack 13 by the jets 22 and 25. Once the topmost sheet of the stack 13 has been captured by the traction device 15 the plunger 23 is lowered and the air jets switched off as illustrated in FIG. 7. Subsequently only the plunger 24 is reciprocated to bring subsequent sheets to be influenced by the traction device as shown in FIG. 8 so that the sheets of the stack are passed in succession but in an overlapping relation to the conveyor 21. Again, the frequency of operation of the plunger 24 is determined by the length of the paper of the stack 13 and the speed at which the conveyor 21 is operating.

It will be apparent that the cam 17 and the plungers 23 and 24 may be extended or may be multiplied across the width of the stack 13 so that the plate 24, which is preferably flexible, is lifted uniformly across its width and not at one or more points only.

Figure 9:
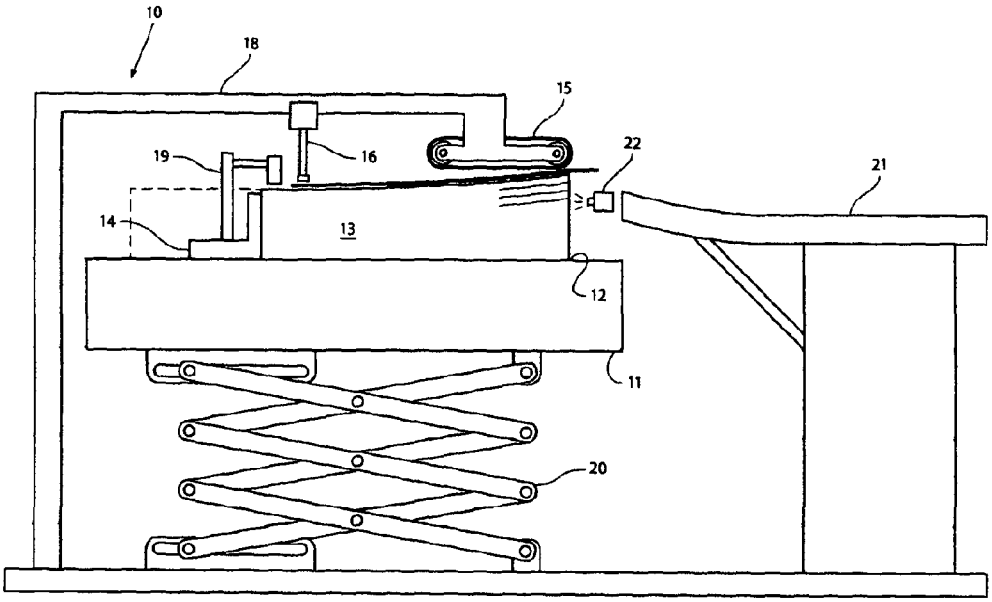
FIG. 9 is a view similar to FIG. 1 of a third embodiment of the invention.
Figure 10:
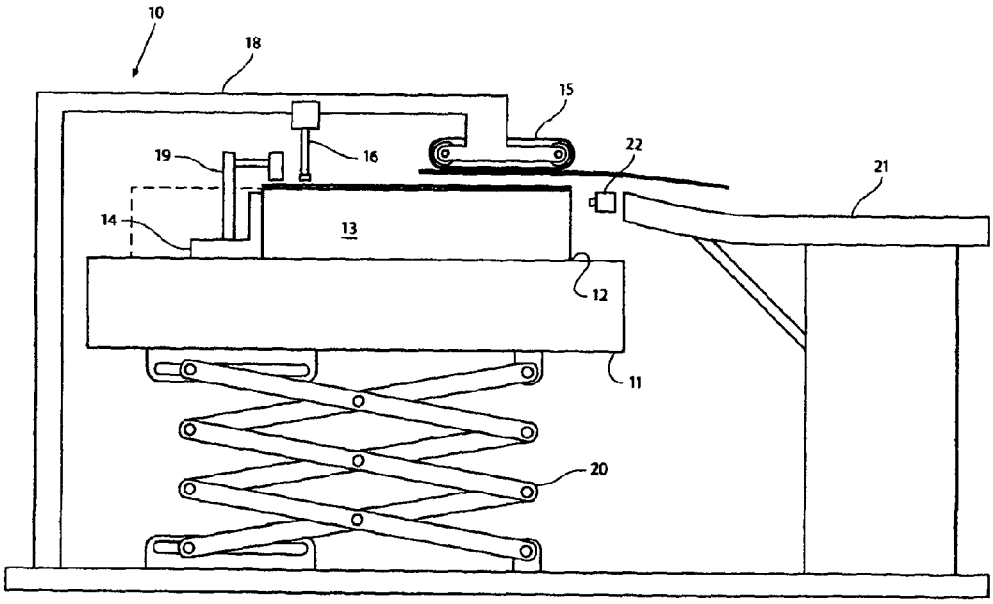
FIG. 10 illustrates an intermediate stage using the mechanism of FIG. 9 in which the air jets are inoperative.
Figure 11:
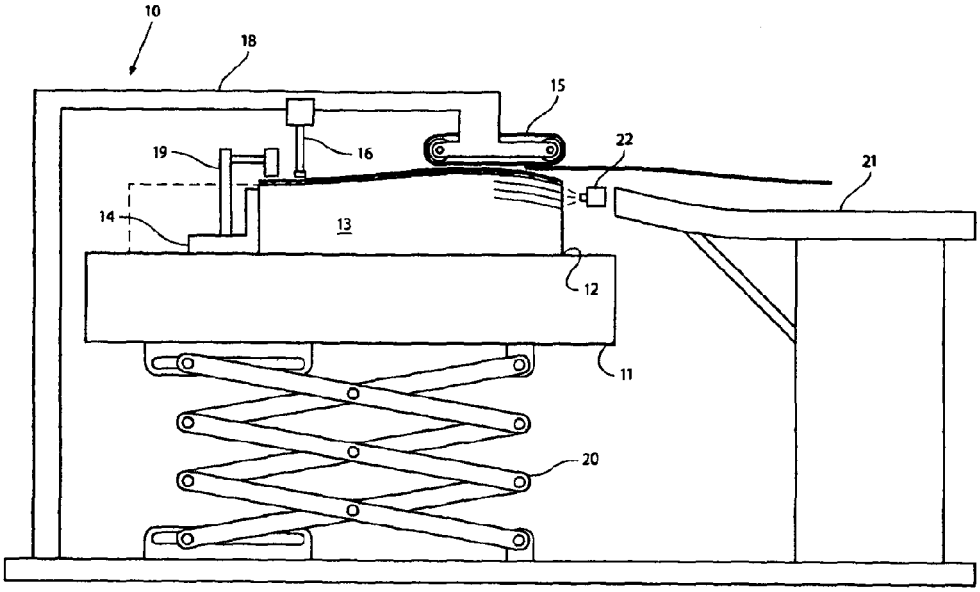
FIG. 11 illustrates the mechanism of FIGS. 9 and 10 lifting a subsequent sheet into overlapping relation with the first sheet.

In the embodiment of the invention illustrated in FIGS. 9 to 11 all means for lifting the stack 13 toward the traction device, such as the cam 15 or the plungers 23 and 24, have been dispensed with and jets of air from the blowers 22 and 25 alone raise the topmost sheet of the stack 13 towards the belt of the traction device 15. Initially, as shown in FIG. 9, the air jets are on. With the topmost sheet captured by the traction device 15 the air jets are switched off as shown in FIG. 10. As the trailing edge of the first sheet is about to leave the traction device 15 the air is switched on again and thus raises upper sheets of the stack until what is now the topmost sheet of the stack is in overlapping relation with the sheet about to leave the traction device 15 and is in turn moved by the latter toward the conveyor 21. As in the embodiment of FIGS. 1-5 lazy tongs 20 under the control of the sensor 16 maintain a constant spacing, say 3 cm, between the top of the stack 13, when not influenced by the air jets, and the traction device 15.

Figure 12:
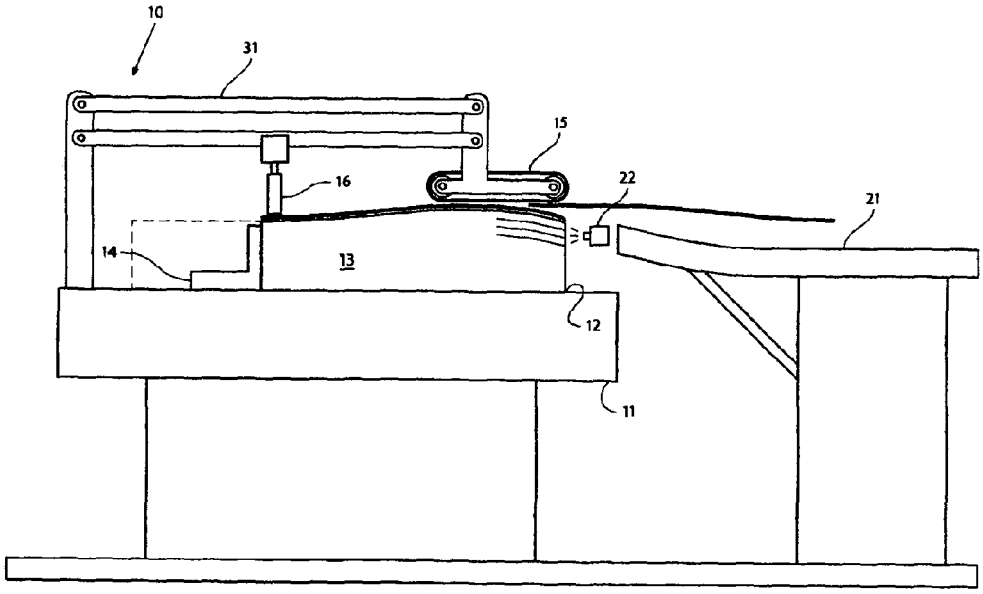
FIG. 12 is a view similar to FIG. 1 of a fourth embodiment of the invention.

In the embodiment of the invention illustrated in FIG. 12 the lazy tongs 20 have been dispensed with and the traction device 15 is supported by a linkage 31 as in FIGS. 6 to 8. As in FIGS. 9 to 11 sheets from the stack 13 are lifted toward the traction device 15 solely by air jets 22 and 25. In this embodiment, also, the pressure member 19 has been dispensed with. The traction device 15 drops under gravity on the linkage 31 as the stack 13 diminishes and is kept at a desired spacing above the top of the stack 13 by the sensor 16 resting on the top of the stack.

The invention claimed is:

1. A feed mechanism for supplying similar sheets to be laminated from a stack thereof in succession but in an overlapping relationship to a laminating machine, the feed mechanism comprising a table for supporting a stack of individual sheets to be laminated, all of the same dimensions and an endless-belt traction device equipped with suction above the table, height-adjustment means for maintaining the traction device at a predetermined spacing above the stack as the stack diminishes and means for elevating the stack from the table to bring the topmost sheet to be captured and displaced by the traction device, the elevating means being actuated to lift the stack before the trailing end of a sheet being moved by the traction device has left the same so that the sheets are fed to the laminating machine in an overlapping relation.

2. A feed mechanism as claimed in claim 1, wherein said means for maintaining the traction device at a predetermined spacing above the stack includes a sensor which controls the height-adjustment means to maintain a constant distance between itself and the topmost sheet of the stack.

3. A feed mechanism as claimed in claim 2, wherein the height-adjustment means is adapted to raise the table as the stack diminishes.

4. A feed mechanism as claimed in claim 3, wherein the height-adjustment means comprises a lazy tongs which supports the table.

5. A feed mechanism as claimed in claim 2 wherein the height-adjustment means is adapted to lower the traction device as the stack diminishes.

6. A feed mechanism as claimed in claim 1, wherein means is provided for timing a reciprocating movement of the elevating means in accordance with the length of the stack and the speed at which the laminating machine is operating to achieve the desired overlap.

7. A feed mechanism as claimed in claim 1, wherein the elevating means is a cam rotatably mounted beneath the top of the table.

8. A feed mechanism as claimed in claim 7, wherein means is provided for rotating the cam initially in an anti-clockwise direction to lift a leading portion of a first sheet to be captured and displaced by the traction device and thereafter intermittently rotating the cam in a clockwise direction to lift a subsequent sheet into contact with a trailing portion of the sheet being carried by the traction device.

9. A feed mechanism as claimed in claim 1 wherein the elevating means comprises a plunger reciprocal between a position below and a position above the top surface of the table.

10. A feed mechanism as claimed in claim 9 wherein the elevating means comprises two plungers reciprocal between positions below and above the top surface of the table, a first plunger being nearer to the leading edge of the stack than the other, the first plunger being actuated to lift the stack to bring a topmost sheet of the stack to be captured and displaced by the traction device and the other plunger being thereafter actuated to bring subsequent sheets to be captured and displaced by the traction device in an overlapping relationship with preceding sheets.

11. A feed mechanism as claimed in claim 1 wherein the elevating means comprises blowers which direct jets of air to separate upper sheets of the stack, the jet being intermittent to achieve a desired overlap of sheets captured and displaced by the traction device.

12. A feed mechanism as claimed in claim 11 wherein a pressure element exerts a downward pressure on the top of the stack to prevent the blowers displacing sheets of the stack away from the conveyor of the laminating machine.

* * * * *